US007717705B2

(12) United States Patent
Erhard

(10) Patent No.: US 7,717,705 B2
(45) Date of Patent: May 18, 2010

(54) SUPPORTING DEVICE FOR ARTICLES TO BE FIRED THAT HAS AN ELASTIC SUPPORT FIXING

(75) Inventor: Winkler Erhard, Rödental (DE)

(73) Assignee: Saint-Gobain Industriekeramik Rodental GmbH, Rodental (DE)

( * ) Notice: Subject to any disclaimer, the term of this patent is extended or adjusted under 35 U.S.C. 154(b) by 372 days.

(21) Appl. No.: 11/814,787

(22) PCT Filed: Jan. 25, 2006

(86) PCT No.: PCT/EP2006/000640

§ 371 (c)(1),
(2), (4) Date: Nov. 6, 2007

(87) PCT Pub. No.: WO2006/079519

PCT Pub. Date: Aug. 3, 2006

(65) Prior Publication Data

US 2008/0193891 A1 Aug. 14, 2008

(30) Foreign Application Priority Data

Jan. 25, 2005 (DE) ..... 10 2005 003 500

(51) Int. Cl.
*F27D 5/00* (2006.01)

(52) U.S. Cl. ..... 432/258; 432/6; 432/241; 432/253; 432/261

(58) Field of Classification Search ..... 432/258, 432/259, 261, 253, 6, 5, 241, 239; 248/523; 211/162, 41.17, 41.18
See application file for complete search history.

(56) References Cited

U.S. PATENT DOCUMENTS 2,434,852 A * 1/1948 Jackson ..... 432/261

FOREIGN PATENT DOCUMENTS

DE 663939 8/1938
DE 2025074 12/1971

(Continued)

OTHER PUBLICATIONS

International Search Report (including translation) for International (PCT) Patent Application No. PCT/EP2006/000640, mailed Jun. 20, 2006.

(Continued)

*Primary Examiner*—Marvin M Lateef
*Assistant Examiner*—Seth G Greenia
(74) *Attorney, Agent, or Firm*—Sheridan Ross PC

(57) ABSTRACT

The present invention relates to a device for supporting, stacking and transporting kiln run, in particular, when firing ceramic products, comprising an assembly from supports and support beams, in particular carrier beams, cross beams, large plates or similar, on which, in particular, one or several supports for placing kiln run are provided. The device comprises at least one substantially rectangular sleeve, in particular disposed on a kiln cart. In this sleeve a substantially rectangular support of the support assembly is disposed, wherein the sleeve has at least one adjustment means, which is supported in the sleeve, and which can be pressed against the support, wherein the sleeve additionally comprises at least one pressure means, formed from at least one elastic element, which is preloaded through the impact of the adjustment devices, so that it builds up reversal forces against the support.

11 Claims, 1 Drawing Sheet

FOREIGN PATENT DOCUMENTS

| | | |
|---|---|---|
| DE | 8201148 | 7/1982 |
| DE | 8420759 | 10/1984 |
| DE | 3422986 | 1/1986 |
| DE | 8802708 | 4/1988 |
| DE | 3716532 | 12/1988 |
| DE | 10154086 | 5/2003 |
| EP | 0081046 | 6/1983 |
| EP | 0330866 | 9/1989 |
| ES | 2024396 | 8/1993 |
| JP | 08-312255 | 11/1996 |

OTHER PUBLICATIONS

Written Opinion (including translation) for International (PCT) Patent Application No. PCT/EP2006/000640, mailed Jun. 20, 2006.

International Preliminary Report on Patentability (including translation) for International (PCT) Patent Application No. PCT/EP2006/000640, issued Jul. 31, 2007.

* cited by examiner

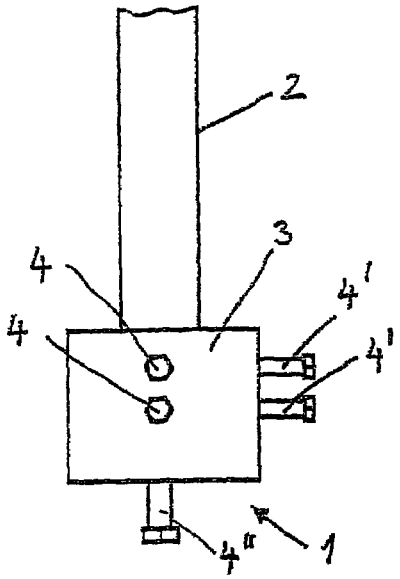
Fig. 1
Fig. 2
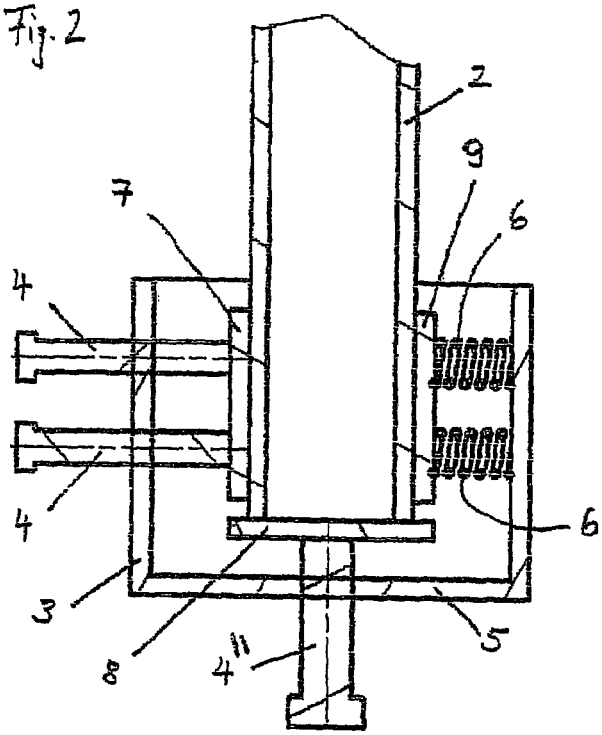
Fig. 3
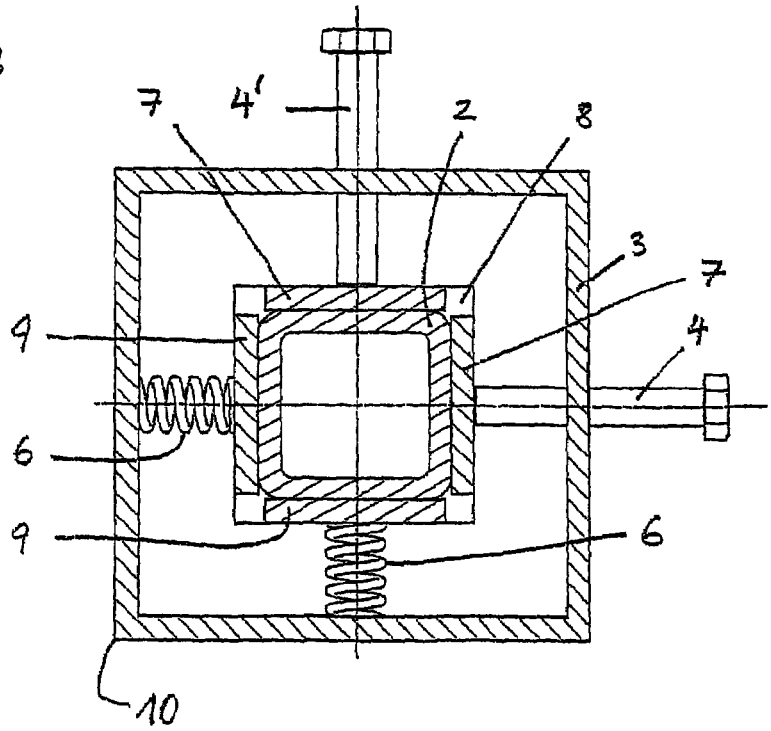

SUPPORTING DEVICE FOR ARTICLES TO BE FIRED THAT HAS AN ELASTIC SUPPORT FIXING

CROSS REFERENCE TO RELATED APPLICATION

This application is a national stage application under 35 U.S.C. 371 of PCT Application No. PCT/EP2006/000640 having an international filing date of Jan. 25, 2006, which designated the United States, which PCT application claimed the benefit of German application Serial No. 10 2005 003 500.0, filed Jan. 25, 2005, the entire disclosure of each of which is hereby incorporated herein by reference.

FIELD OF THE INVENTION

The present invention relates to a device for supporting, stacking, and transporting kiln run, in particular when firing ceramic products.

BACKGROUND OF THE INVENTION

In order to be able to manufacture ceramic products, they have to be fired in a kiln. For importing and exporting into and from the oven, these ceramic products are advantageously supported on a device, which can be moved into the oven and removed again. In the state of the art, respective kiln carts are known, having fire resistant superstructures (kiln cart superstructures), comprising support assemblies, in which respective holders or support systems for ceramic products or the kiln run in general are formed from several supports, support carriers, like carrier beams, cross beams, large plates or similar.

According to a known embodiment, the supports are connected to the kiln cart through steel receivers. Such steel receiver comprises pairs of vertical threaded bolts, disposed on all sides, on top of each other, which are vertically and centrally aligned with the support, which is typically provided as a rectangular tube. The support is thus clamped tight on all sides and can be aligned through counteracting adjustment of the respective opposite pairs of threaded bolts.

This conventional system for fixating and adjusting the support of a kiln cart superstructure, however, has various disadvantages. Thus it is very difficult to align the support in particular in vertical direction, since hereby two respective pairs of threaded bolts have to be adjusted in a precisely counteracting manner, and all bolt pairs, thus eight bolts, have to be loosened. Thereby, it is e.g. difficult in particular to align several supports of a kiln cart superstructure with each other. Furthermore, the bolts can become loose already after few kiln cycles, since these kiln cycles cause thermal expansions in the support, in the steel receiver, and in the bolts through heating and cooling, which in turn can loosen the fixation of the support. These expansions can furthermore damage the support, which is typically made from ceramic material, e.g. $Al_2O_3$, RSiC, SiSiC, NSiC or Mullite. Furthermore, on the one hand, during the transportation of the kiln cart, on the other hand, through collisions of two kiln carts, shocks can occur at the kiln cart. Such shocks to the kiln cart are transmitted to the superstructure of the kiln cart without attenuation, and thereby to the kiln run, located thereon, in particular, to sensitive ceramic products. Not only the kiln run, but also the entire kiln cart superstructure, made from ceramic material, is sensitive with respect to such shocks, since these ceramic materials are known to be sensitive with respect to tension and/or bending loads.

Thus it is the object of the present invention to provide a device for holding and supporting, or stacking and transporting kiln run, in particular kiln run for firing ceramic products, which avoids the disadvantages of the above described state of the art. In particular, a device shall be provided, which allows a simple alignment of a support. Thereby, the device shall attenuate shocks to the kiln cart, relative to the kiln cart superstructure, and a loosening of the fixation of the support shall also be avoided over several kiln cycles. Furthermore, this device shall be simple to manufacture.

SUMMARY OF THE INVENTION

The device according to the invention for supporting, stacking and transporting kiln run comprises an assembly of supports and support carriers, in particular carrier beams, cross beams, large plates, or similar, and at least one sleeve, in which a support is disposed. The sleeve and the support are provided substantially rectangular, but they can also have other cross sections like round or polygonal. The sleeve, on the one hand, has at least one adjustment means, which is supported in the sleeve, and can be pressed against the support, and on the other hand, additionally comprises a at least one pressure means formed by at least one element with elastic effect, which is preloaded through the impact of the adjustment means, and thereby builds up reversal forces against the support. The sleeve is preferably disposed on a kiln cart, so that in particular ceramic kiln run, which is placed onto the support assembly, can be moved in and out of the kiln in the simplest possible manner, possibly even in an automated manner. Through the opposite arrangement of the adjustment means and the pressure means, a very simple alignment of the support is possible in the sleeve. Furthermore, the sleeve cannot become loose through the thermal expansion during the oven cycle, due to the resilient support of the pressure means, since the pressure means compensate for such thermal expansion, flexibly pressing the support against the adjustment means at any time. An additional advantage of the device according to the invention is that during thermal or mechanical displacement, the support automatically returns into its initial position again after unloading. The pressure means is preferably provided as a coil or disc spring, allowing a preload of 500 to 2000 N. However, e.g. also an elastic plastic sleeve, leaf spring or similar can be used.

This advantageous embodiment can still be improved through providing pressure plates, preferably made from steel, between the adjustment means, or the pressure means and the support, in order to avoid punctiform compression stress peaks. In an advantageous manner, these pressure plates can be thermally decoupled from the support, through an additional layer from a thermally insulating material. In particular, such a layer comprises a ceramic hard fiber or a mica laminate material.

In a preferred embodiment, the bottom of the sleeve is substantially closed and an adjustment means is disposed at the bottom of the sleeve. With this adjustment means, a defined elevation adjustment of the sleeve can be performed. The bottom of the sleeve is thus functionally connected with the sleeve, this means, so that it does not have to be directly mechanically connected to the sleeve. Furthermore, the sleeve can be mounted at the bottom e.g. of a kiln cart, so that the bottom of the oven cart then functionally forms the bottom of the sleeve, and the elevation adjustment means is disposed therein.

In an advantageous embodiment, in the device according to the invention, two first adjustment means are disposed on one side of the sleeve substantially in the center and vertically above each other. The vertical distance of the adjustment means is 20 to 100 mm in case of the typically used supports, so that a one sided vertical alignment of the support is enabled in the plane, which is parallel to the first adjustment means.

Then, in an advantageous manner, two second adjustment means can be disposed on a side of the sleeve, adjacent to the side with the first adjustment means, substantially in the center and vertically on top of each other, so that thus with the first and the second alignment means, an omni lateral vertical alignment of the support becomes possible. As an alternative to the two second adjustment means, on the sides of the sleeve, adjacent to the first adjustment means, a third and a fourth and a fifth adjustment means can be disposed, substantially vertical offset from the third and horizontally offset from each other. Thereby, it is not only possible to align the supports vertically on all sides, but additionally also the alignment of a support relative to another support can be adjusted, thus a rotation of the support around its lateral axis can be effected. For the typically used supports of kiln cart superstructures, the vertical and horizontal distances of the third, fourth and fifth adjustment means are 20 to 100 mm respectively. The third, the fourth, and the fifth adjustment means can thereby be disposed in the shape of an L or T, wherein the first embodiment is more advantageous, since purely horizontal (rotation) and purely vertical effects on the support are possible.

Preferably, one or several pressure means act on two adjacent sides of the sleeve, substantially in the center, so that through the effect of the adjustment and pressure means no sheer forces are imparted into the support. As an alternative, and for saving materials, however, it also possible to dispose one or several pressure means at a vertical edge of the sleeve, which then impact the support in a diagonal manner, through a lateral edge of the support.

As an adjustment means, preferably threaded bolts are applied, since a particularly simple and fine adjustment of the support thereby becomes possible with them. The position of the alignment means can preferably be determined through suitable fixation means. A particularly simple fixation of threaded bolts can thereby be accomplished through counter nuts.

The advantages relative to the devices according to the state of the art are evident now. While no rotation and thus no parallel alignment of the support is possible there, and eight bolts always have to be loosened and synchronically adjusted for adjustment, in the present invention the adjustment means can be adjusted independently from each other, since pressure means disposed respectively perpendicular to this adjustment means on an adjacent side of the sleeve, allow a motion of the support perpendicular to these pressure means.

BRIEF DESCRIPTION OF THE DRAWINGS

Subsequently, an embodiment of a device for supporting, stacking, and transporting of kiln run is described with reference to the schematic drawing, showing in:

FIG. 1 a cutout of a lateral view of an embodiment of the device according to the invention;

FIG. 2 a vertical sectional view of the embodiment according to FIG. 1; and FIG. 3 a horizontal sectional view of the embodiment according to FIG. 1 and FIG. 2.

DETAILED DESCRIPTION

FIG. 1 shows a device 1 according to the invention in a schematic cutout view for supporting, stacking and transporting kiln run with a support 2 and a sleeve 3. For omni lateral vertical adjustment of the support 2, two pairs of adjustment means 4, 4' are disposed on two adjacent sides of the sleeve. The adjustment means 4, 4' are thereby disposed vertically above each other, possibly with a spacing of 50 mm, and in a central manner with reference to the sleeve 3 and the support 2. For elevation adjustment of the support 2, an adjustment means 4" is provided in the bottom of the sleeve. The adjustment means 4" is thereby centrally located in the bottom of the sleeve. Preferably the adjustment means 4, 4', 4" are threaded bolts, which are rotatably supported in the sleeve 3.

FIG. 2 shows a vertical cut through the device 1 according to the invention in a plane perpendicular to the depiction plane of FIG. 1, and through the bolts 4' and 4". On the opposite side of the bolts 4, two coil springs 6 are disposed in the sleeve 3. Between the bolts 4, 4', 4", and the coils springs 6 and the support 2, pressure plates 7, 8, 9 are disposed, in order to avoid punctiform compression stress peaks at the support 2, which is typically comprised of ceramic material, as e.g. $Al_2O_3$, RSiC, SiSiC, NSiC or Mullite. These pressure plates 7, 8, 9 are preferably made from steel, and can be mechanically connected via suitable means (not shown) with the bolts 4, 4', 4" and the coil springs 6, so that the position of the pressure plates 7, 8, 9 with reference to the associated bolts 4, 4', 4", and with reference to the coil springs 6 does not change during a horizontal or vertical adjustment of the support 2. Certainly, it is also possible to mechanically connect the pressure plates 7, 8, 9 with the support 2, or to connect them mechanically neither with the support 2, nor with the bolts 4, 4', 4" and the coil springs 6. For stability reasons, the sleeve 3 is made from steel, however, it can also be made from another material like ceramic, aluminum, Ti-Alloy, or similar. For thermal and mechanical decoupling of the sleeve 3 from the support 2, layers e.g. from ceramic hard fiber or a mica laminate can be disposed between the support 2 and the pressure plates 7, 8, 9.

FIGS. 2 and 3 show, that the bolts 4, 4' impact the respective coil springs 6 in a direct line, thereby elastically fixating the support 2 in the sleeve 3, and furthermore, an input of shear forces is avoided. A thermal expansion of single components of the kiln cart superstructure is elastically compensated by the coils springs 6, so that the mounting of the support 2 in the sleeve 3 is permanently maintained also after several heating cycles. Through the pressure plates 7, 8, 9 not only compression stress peaks are kept away from the support 2, but a surface oriented, and thereby defined effect of the bolts 4, 4', and of the coil springs 6 onto the support 2 is assured. Through this embodiment of the present invention it is possible to adjust and fixate the support 2, which is provided as a hollow rectangular tube, but which can also be provided solid, through two pairs of threaded bolts, in three dimensions, vertically in all directions and also in the horizontal and the vertical direction.

It is certainly also possible to dispose one or several coil springs at the edge 10 of the sleeve 3, instead of the two coil springs 6, disposed in alignment with the bolts 4, 4', so that they impact the support 2 diagonally and impact the bolts 4, 4' at an angle of 135°. A suitable pressure plate, which is disposed between these coil springs and the support 2, would then be e.g. a steel angle profile.

In order to expand the alignment possibilities of the support 2, a vertical pair of bolts 4, 4' can be replaced by three bolts, which are substantially disposed in a L or a T shape, or in a vertically mirrored shape, wherein e.g. two bolts are horizontally disposed in a plane, and symmetrical to the center of the wall of the sleeve, and the third bolt is vertically offset above or below, and disposed in the center of the sleeve. This way it is possible not only to align the support 2 vertical in all directions, and spatially in the horizontal and vertical plane, but through the two bolts offset in a horizontal plane, a rotation of the support 2 around its lateral axis can be adjusted. This is particularly advantageous, when two supports are to be aligned in flush.

What is claimed is:

1. A device for supporting, stacking and transporting a kiln run when firing ceramic products, comprising substantially rectangular supports and support carriers, with at least one substantially rectangular sleeve, disposed on a kiln cart, a substantially rectangular support disposed in the sleeve, wherein the sleeve has at least one adjustment means, which is supported in the sleeve, and which can be pressed against the substantially rectangular support, wherein the sleeve additionally comprises at least one pressure means, formed from at least one elastic element, which is preloaded through impact of the adjustment means, so that the pressure means builds up opposing forces against the substantially rectangular support.

2. A device according to claim 1, wherein the pressure means is formed through coil or disc springs with a high preload of 500 to 2000 N.

3. A device according to claim 1, wherein pressure plates are provided between the adjustment means or the pressure means and the substantially rectangular support.

4. A device according to claim 3, wherein the pressure plates comprise a layer made from thermally insulating material, comprising a hard ceramic fiber or a mica laminate, in order to thermally decouple the substantially rectangular support from the sleeve.

5. A device according to claim 1, wherein a bottom of the sleeve is substantially closed, and the adjustment means for elevation alignment of the substantially rectangular support is disposed in the bottom of the sleeve.

6. A device according to claim 1, wherein two first adjustment means are disposed on one side of the sleeve, substantially in the center, and vertically on top of each other, for unilateral vertical alignment in a plane parallel to a first adjustment means of the substantially rectangular support.

7. A device according to claim 6, wherein two second adjustment means are disposed on a side adjacent to the side of the sleeve with the adjustment means, substantially in the center, and vertically on top of each other, for omni lateral vertical alignment of the substantially rectangular support.

8. A device according to claim 6, wherein a third adjustment means is disposed on a side of the sleeve, adjacent to the side with the adjustment means, and a fourth and a fifth adjustment means are disposed vertically offset from the third adjustment means, and horizontally offset from each other.

9. A device according to claim 1, wherein at least one pressure means each is disposed on two adjacent sides of the sleeve, impacting the substantially rectangular support substantially in the center, or disposed on a vertical edge of the sleeve, impacting the substantially rectangular support diagonally.

10. A device according to claim 1, wherein the adjustment means are threaded bolts.

11. A device according to claim 1, wherein the adjustment means comprise means for fixating the position of the adjustment means.

* * * * *